US007748799B2

(12) United States Patent
Kleinsasser

(10) Patent No.: US 7,748,799 B2
(45) Date of Patent: Jul. 6, 2010

(54) DRIVE DEVICE FOR A MOVABLY MOUNTED FURNITURE PART

(75) Inventor: Gerhard Kleinsasser, Dornbirn (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/802,067

(22) Filed: May 18, 2007

(65) Prior Publication Data

US 2007/0222346 A1 Sep. 27, 2007

Related U.S. Application Data

(63) Continuation of application No. PCT/AT2005/000448, filed on Nov. 10, 2005.

(30) Foreign Application Priority Data

Dec. 3, 2004 (AT) ..... A 2036/2004

(51) Int. Cl.
*A47B 88/04* (2006.01)

(52) U.S. Cl. ..... 312/319.1; 312/333

(58) Field of Classification Search ..... 312/319.1, 312/330.1, 331, 333, 334.1, 334.7, 334.6, 312/334.8; 384/20, 21, 22
See application file for complete search history.

(56) References Cited

U.S. PATENT DOCUMENTS

| | | | | |
|---|---|---|---|---|
| 3,836,222 | A | 9/1974 | Kuntze | |
| 4,494,806 | A * | 1/1985 | Williams et al. | 312/333 |
| 4,596,427 | A * | 6/1986 | Pflugfelder | 312/319.1 |
| 4,712,845 | A * | 12/1987 | Nicol | 312/222 |
| 5,135,294 | A * | 8/1992 | Ohshima et al. | 312/319.1 |
| 5,143,432 | A * | 9/1992 | Ohshima et al. | 312/319.1 |
| 5,580,138 | A * | 12/1996 | Grabher | 312/319.1 |
| 2003/0067257 | A1 | 4/2003 | Gasser | |

FOREIGN PATENT DOCUMENTS

| | | |
|---|---|---|
| CN | 1362866 | 8/2002 |
| DE | 1 262 533 | 3/1968 |
| DE | 1778452 | * 10/1971 |
| DE | 198 23 305 | 12/1999 |
| EP | 0 386 731 | 9/1990 |
| EP | 0 391 221 | 10/1990 |
| EP | 760309 | * 3/1997 |
| EP | 0 847 937 | 6/1998 |
| EP | 1 127 514 | 8/2001 |
| EP | 1 249 191 | 10/2002 |
| EP | 1 384 420 | 1/2004 |
| GB | 2 297 578 | 8/1996 |

* cited by examiner

*Primary Examiner*—James O Hansen
(74) *Attorney, Agent, or Firm*—Wenderoth, Lind & Ponack, L.L.P.

(57) ABSTRACT

The invention relates to a drive device for a furniture part that is displaceably mounted in relation to a furniture body, in particular for a drawer or similar. The device includes an energy accumulator device, which supports the displacement of the furniture part. According to the invention, the displaceable furniture part can be essentially displaced into a fully open position by the energy accumulator device, thus partially discharging the energy accumulator device. The energy accumulator device is then re-charged during the closing operation of the displaceable furniture part. The energy accumulator device only acts on part of the displacement path of the furniture part.

15 Claims, 6 Drawing Sheets

A-A
1
2
3
6
8
10
11
12
13
13'
13"
14
15
16
17
A
D 1
3
6
8
10
10'
11
12
13
13'
13"
13a
14
14'
15
16
A, 19
B, 2

DRIVE DEVICE FOR A MOVABLY MOUNTED FURNITURE PART

This application is a continuation of International Application No. PCT/AT2005/000448, filed Nov. 10, 2005.

BACKGROUND OF THE INVENTION

The present invention relates to a drive device for a furniture part which is mounted movably relative to a furniture body, particularly for a drawer or the like, having an energy storage device which assists the movement of the furniture part.

The invention also relates to an item of furniture with a furniture part which is mounted movably relative to a furniture body, and also to a method of moving a furniture part of this kind into its open position.

According to the prior art, numerous embodiments of retraction devices are known, in which an energy storage device conveys the furniture part into the fully closed position. It is also known to provide such retraction devices with damping devices, which, if the movable furniture part is swung shut, at least reduce the banging noises occurring thereby, and thus also reduce the mechanical stress upon the system components. European Patent EP 0 391 221 describes a closure device for drawers, in which a displaceable rocker segment is brought into a stand-by position counter to the force of a spring when the drawer is pulled out. When the drawer is pushed in, the rocker segment is disengaged again by virtue of an entrainment member, wherein the rocker segment is being pulled back into its initial position by a spring. In so doing, the rocker segment entrains the entrainment member of the drawer, so that the drawer is retracted into its fully closed position.

SUMMARY OF THE INVENTION

It is an object of the present invention to propose a drive device of the kind mentioned in the introduction, by means of which the movable furniture part can be moved into the fully open position, wherein this operation is intended to take place as uniform as possible.

According to the invention, the above object is achieved by virtue of the fact that a movable furniture part can be moved essentially into the fully open position by an energy storage device (energy storage member), during which the energy storage device is at least partly discharged. During the closure operation of the movable furniture part, the energy storage device is rechargeable, and the energy storage device is only effective over part of the path of movement of the furniture part.

By virtue of the energy storage device of the aforementioned kind, temporary coupling of the energy storage device with the movable furniture part is made possible, so that this latter can be moved into the fully open position. A movement of the movable furniture part in the direction of its closed position, starting from the fully open position, causes the energy storage device to be charged, so that a new stand-by position can be set up. During the opening procedure, the movable furniture part is initially freely movable until it is moved by a releasable coupling device back further towards the direction of its fully open position.

The opening of the drawer into the fully open position by the inventive drive device is advantageous in several ways. With the opening of short drawers, rebounding can be effectively prevented, particularly if there is damping over the last region of opening of the pull-out path. Another advantage is the ease of operation and the avoidance of accidental self-closure. If removably fitted inserts, or objects, are inside the drawer, which require the drawer to be pulled out fully in order for them to be removed, the drive device according to the invention can be used to advantage in such a situation.

A preferred embodiment of the invention provides that the energy storage device has a spring device with at least one spring. As a result, the drive device is simple in its construction and is inexpensive to make. Alternatively, or as an additional measure, the energy storage device can also be equipped with at least one pressurized gas storage device. In this case, it can also be advantageous to use the power from an external energy source—e.g. an electric motor—to form and/or assist the energy storage device.

Advantageously, the drive device has a rocker segment which is preferably spring-loaded and which can be releasably coupled to an entrainment member, and the entrainment member tensions the spring by the rocker segment during closure of the movable furniture part. The rocker segment then reaches a stand-by position which is arrested in self-locking manner, and then releases the entrainment member. The rocking of the rocker segment can thus be controlled with accuracy, and is not dependent upon the greater or lesser extent to which pull is exerted upon the movable furniture part.

In terms of its construction, the design can be such that the rocker segment is arranged on the furniture body, and the entrainment member is arranged on the movably mounted furniture part. However, the reverse solution also lies within the scope of the invention, namely, that the rocker segment is arranged on the movably mounted furniture part, and the entrainment member is arranged on the furniture body.

An advantageous embodiment of the invention results if the rocker segment is preferably guided in a displaceable manner linearly along a guide path. The rocker segment can be guided with accuracy along the path of movement provided for it, thus permitting reliable coupling which is free of clearance. The guide path can lie in a rail which is held by a fixing means to the side wall of the furniture body.

As an alternative, the design can be such that the rocker segment is mounted rotatably about an axis, and can be moved into a stand-by position which is arrested in a self-locking manner. This results in a space-conserving variant in comparison to the rocker segment which is guided in the guide path.

So that the movable furniture part is not brought into the fully open position with too much momentum, it is advantageously provided that a damping device is provided which dampens the movement of the furniture part over at least part of its path of opening. The damping device can essentially be based on any solutions known in the prior art, the use of linear dampers, or even rotary dampers, advantageously being possible.

The arrangement of the damping device can also vary. One embodiment provides that the damping device is arranged on the movable furniture part. It can also be advantageous if the damping device is arranged on a guide rail of a pull-out guide fitting. Alternatively, it can also be provided that the damping device is arranged on the rocker segment. Depending upon the application—e.g. in the case of drawers which are very heavy, or which are to be loaded so that they will become heavy—a combination of the afore-mentioned damping arrangements is provided within the scope of the invention.

Another advantageous embodiment of the invention results if a closure device is additionally provided by means of which the movable furniture part can be moved into its fully closed position. The movable furniture part can thus be moved within the region of the two end positions of the path of movement, both into the fully closed position as well as into the fully open position, gentle and smooth closure and opening operations being possible into both end positions.

The item of furniture according to the invention with a furniture part which is mounted movably relative to a furniture body is characterized in that it has a drive device of the afore-mentioned kind.

The method according to the invention for moving into its open position a furniture part which is movably mounted relative to a furniture body is characterized in that the movable furniture part is initially freely movable during the opening operation. Then, the furniture part is taken hold of by a detachable coupling device (rocker segment), is pulled further in the direction of its open position by an energy storage device, and a damping device provides damping over the last path of opening.

A preferred embodiment of the afore-mentioned method results if the damping effect of the damping device upon opening of the furniture part only begins when the detachable coupling device (rocker segment) has coupled the movable furniture part, or an entrainment member of same, to the energy storage device. If the movable furniture part, or the entrainment member thereof, is not coupled, then the movable furniture part could possibly move backwards when travelling onto the damping device, in which case smooth pulling out could not be ensured.

BRIEF DESCRIPTION OF THE DRAWINGS

Further details and advantages of the present invention will be mentioned hereinafter in greater detail with the aid of the description of the drawings relating to the Figures.

DETAILED DESCRIPTION OF THE INVENTION

Figures 1A, 1B, 1C:
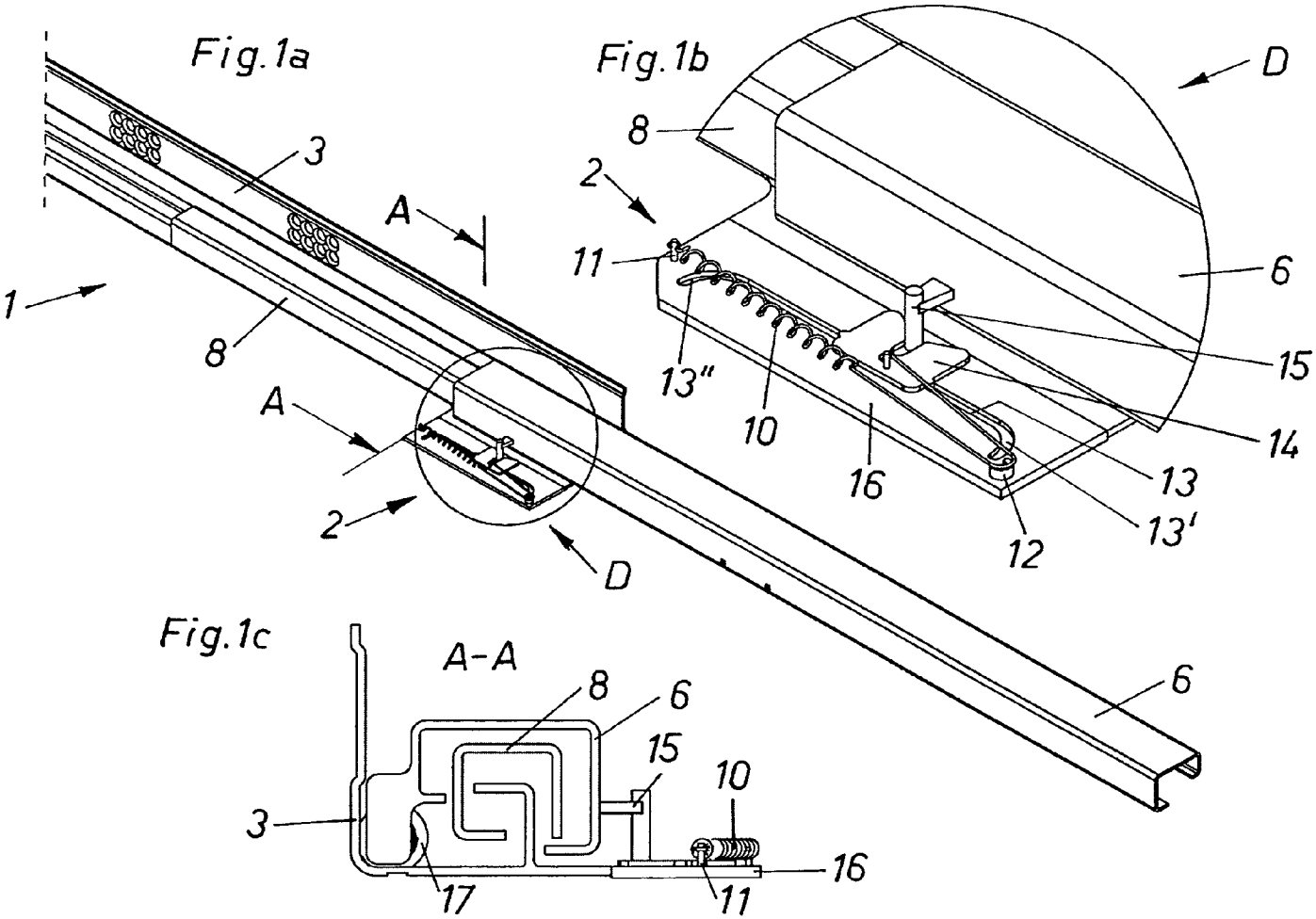
FIGS. 1*a*, 1*b*, 1*c* show the front region of a pull-out guide fitting for drawers with a drive device according to the invention, and also detailed drawings on a larger scale.

FIG. 1*a* shows the front region of a pull-out guide fitting 1 for drawers with the drive device 2 according to the invention. FIG. 1*b* is a view of the detail D in FIG. 1*a*, and FIG. 1*c* is a sectional drawing taken along the line A-A of FIG. 1*a*. The pull-out guide fitting 1 is in the open position, the drawer rail 6 being engaged with the drive device 2. Other than in respect of the drive device 2, the pull-out guide fitting 1 corresponds to the prior art, i.e. a carcass rail 3 is fixedly connected with a furniture body. Between the carcass rail 3 and the drawer rail 6 there is a central rail 8 which is displaceable relative to these two rails 3, 6. The load between the rails is transmitted by means of rollers, balls or rolls, or conventional carriages, not shown. The drive device 2 is preferably disposed in the front half of the pull-out path of a drawer which is fixedly connected to the drawer rail 6. The drive device 2 can be arranged between the side wall of the drawer and the side wall of the carcass rail 3, or it can also be arranged under the bottom of the drawer.

The drive device 2—as shown in FIG. 1*b*—comprises an energy storage device 10 in the form of at least one (tension) spring by means of which a drawer can be moved into its fully open position. The energy storage device 10 is pivotably connected to the fixing journal 11, on the one hand, and communicates via the direction-changing member 12 with a rocker segment 14. The rocker segment 14 can be of a forked configuration, and is displaceable along a guide path 13 by means of an engaging journal. The guide path 13 has a straight portion, in both end regions of which the arcuate portions 13' and 13" are arranged.

In the drawing shown, an entrainment member 15 (i.e., a first member) makes contact with the rocker segment 14 (i.e., a second member). The entrainment member 15 is secured fixedly in the rear region of the drawer rail 6, or is formed thereon. However, the entrainment member 15 can also be secured directly to a side wall of the drawer. If the drawer is then opened, starting from its fully closed position, it is possible to initially move it freely. At that time, the spring-loaded rocker segment 14 is disposed in the arcuate portion 13" in a stand-by position which is arrested in a self-locking way. When the drawer approaches its fully open position, the entrainment member 15 is grasped by the rocker segment 14. When this happens, the rocker segment 14 is lifted by the entrainment member 15 out of the arcuate portion 13", and is moved by spring force in the direction of the second arcuate portion 13'. In this position, the entrainment member 15 is able to be released again from the rocker segment 14, so that free running of the entrainment member 15, or of the drawer, is possible. As an alternative, the entrainment member 15 can also continue to be connected to the rocker segment 14, which, of course, simultaneously denotes the fully open position. In order to move the drawer, or the entrainment member 15, into the fully open position, it is advantageously provided that the energy storage device 10 is designed such that it does not become fully discharged when the drawer is in the fully open position. This means that, in that position, the spring(s) is/are at least partly tensioned, so that the rocker segment 14 is tensioned even when the drawer is fully open.

If the movable furniture part is closed, starting from its fully open position, then the entrainment member 15 becomes once again coupled to the rocker segment 14, and the energy storage device 10 becomes recharged, i.e. the spring is tensioned. When the movable furniture part moves further in the direction of its closed position, the rocker segment 14 again takes up a stand-by position which is arrested in self-locking manner (rocker segment 14 in the arcuate portion 13') and releases the entrainment member 15, so that the drawer can be moved into the closed position.

FIG. 1*c* shows a sectional drawing along the axis A-A in FIG. 1*a*, in which the position of the rails 3, 6, 8 relative to one another is visible. For the sake of simplicity no load-transmitting members, such as balls, rolls, or the like, are shown. In order to prevent the drawer from reaching the fully open position with a loud banging noise, a damping device 17 is shown here by way of example, which can have at least one linear damper or rotary damper.

Figure 2A:
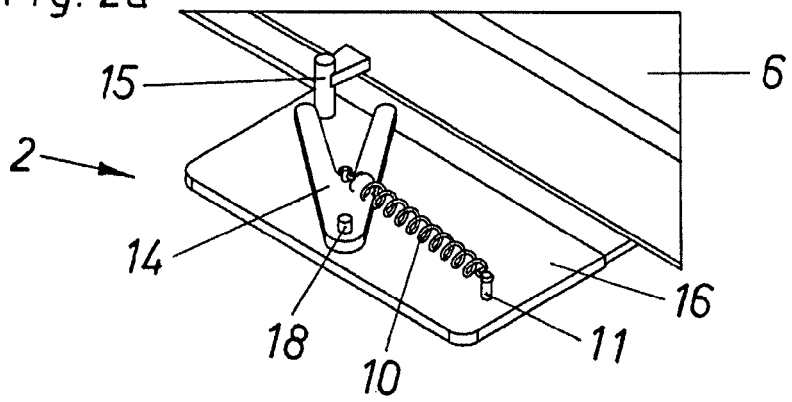
FIGS. 2*a*, 2*b*, 2*c* show the chronological sequences of opening the drawer, according to an alternative embodiment.
Figure 2B:
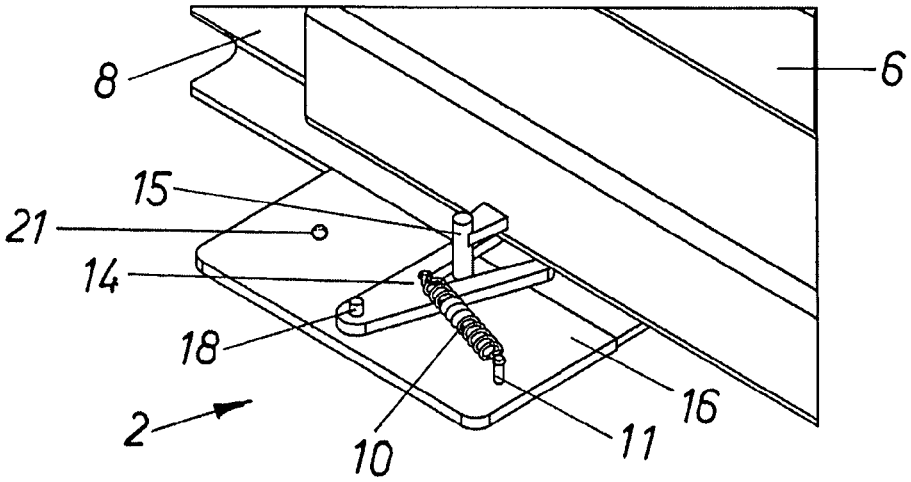
Figure 2C:
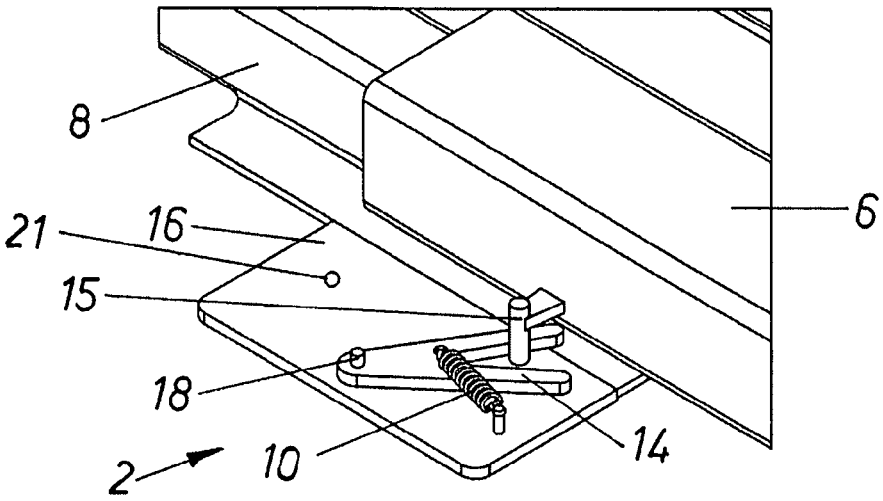

FIGS. 2*a*, 2*b*, 2*c* show chronological sequences of the opening procedure, according to an alternative embodiment of the invention. Instead of the rocker segment 14 which can be displaced in a linear manner, as shown in FIGS. 1*a*-1*c*, a V-shaped rocker segment 14 is provided which is mounted rotatably about an axis 18. The energy storage device 10 comprises a spring which is coupled to the fixing journal 11, on the one hand, and to the rocker segment 14, on the other hand. The projecting flap 16 is arranged in the front region of the carcass rail 3, and serves to receive the drive device 2. In FIG. 2*a*, the rotatably mounted rocker segment 14 is disposed in a stand-by position which is arrested in a self-locking manner. This can be done easily by virtue of a detent, or by a lug disposed on the underside of the rocker segment 14 which co-operates with a cavity 21 formed in the flap 16, as shown by way of example in FIG. 2*b*. FIG. 2*b* also shows the entrainment member 15 which is already to be found in the engaged condition and which is displaced by spring force, to the right, in the direction of the open position. FIG. 2*c* shows the essentially fully open position of the drawer rail 6 relative to the central rail 5. In the embodiment shown, the entrainment member 15 remains in the section of the V-shaped rocker segment 14, so that no free running of the drawer rail 6 is provided. If the drawer rail 6 is pushed in again, then operation can be completed in the sequence: FIGS. 2*c*-2*b*-2*a*. The energy storage device 10 is recharged, the spring is thus tensioned, and the rocker segment 14 is returned to the arrested stand-by position shown in FIG. 2*a*.

Figures 3A, 3B, 3C:
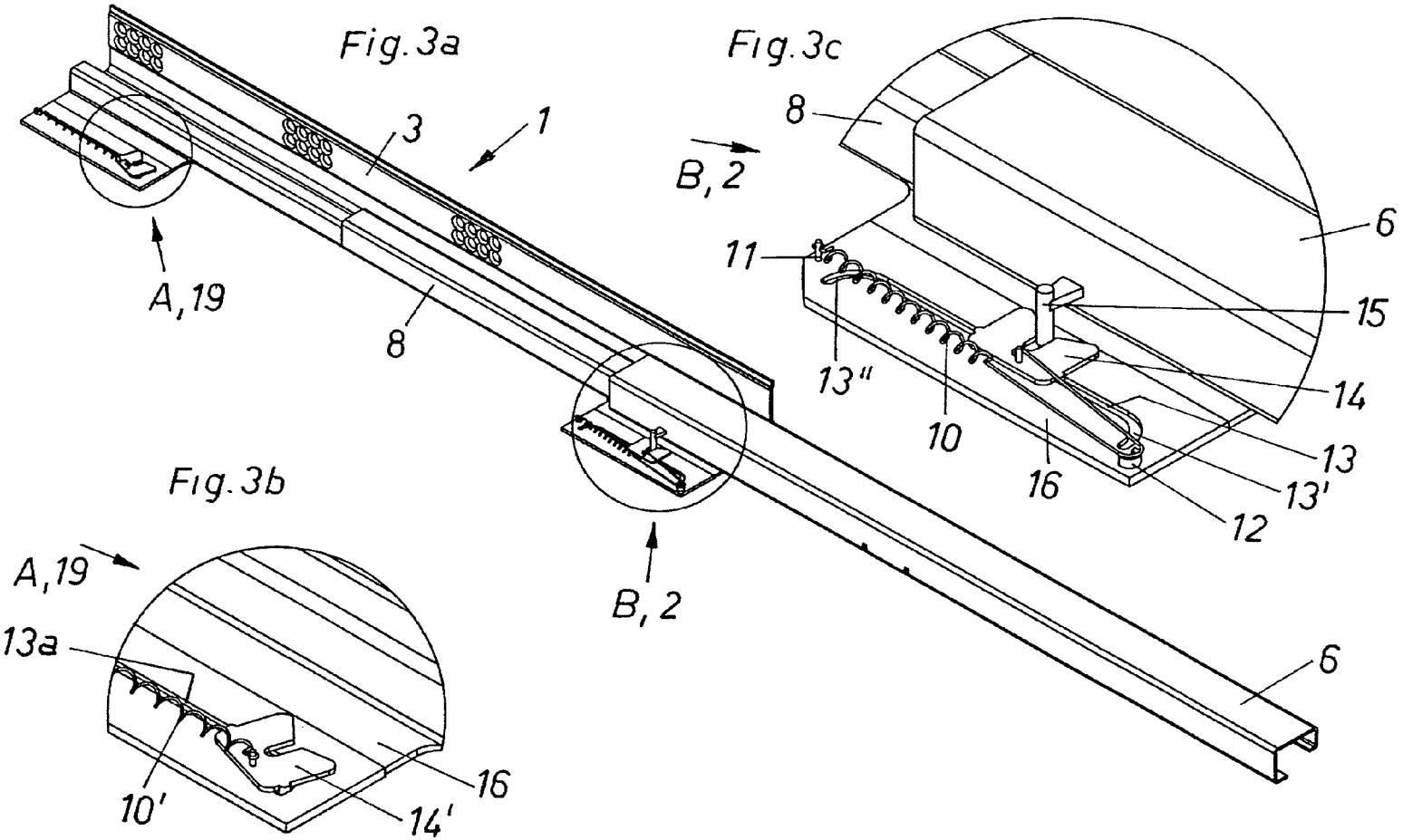
FIGS. 3*a*, 3*b*, 3*c* show the embodiment from FIGS. 1*a*-1*c* with an additional closure device, and also detailed drawings on a larger scale.

FIGS. 3*a*, 3*b*, 3*c* show the embodiment from FIGS. 1*a*-1*c*, wherein in addition to the drive device 2, a closure device 19 is provided by means of which the movably mounted furniture part is movable into its fully closed position. The closure device 19 corresponds basically to the prior art, and can have a damping device which provides dampening over the last closure path of the drawer until it is in the fully closed position. FIG. 3*a* shows the detail A from FIG. 1*a*, wherein from a constructional viewpoint the components of the closure device 19 correspond to the components of the drive device 2. A rocker segment 14' is guided displaceably along a guide path 13*a*. However, in the rear region the guide path 13*a* has a straight section because in this fully closed position it is not absolutely necessary for the entrainment member 15 to be disengaged. If the drawer is then moved in the direction of its closed position, the entrainment member 15 becomes coupled to the rocker segment 14'. The rocker segment 14' is lifted out of the arrested stand-by position, and is pulled by spring force into the most rearward closed position. FIG. 3*c* shows the detail B with the drive device 2, wherein the functional description can be deduced from FIG. 1*b*.

Figures 4A, 4B:
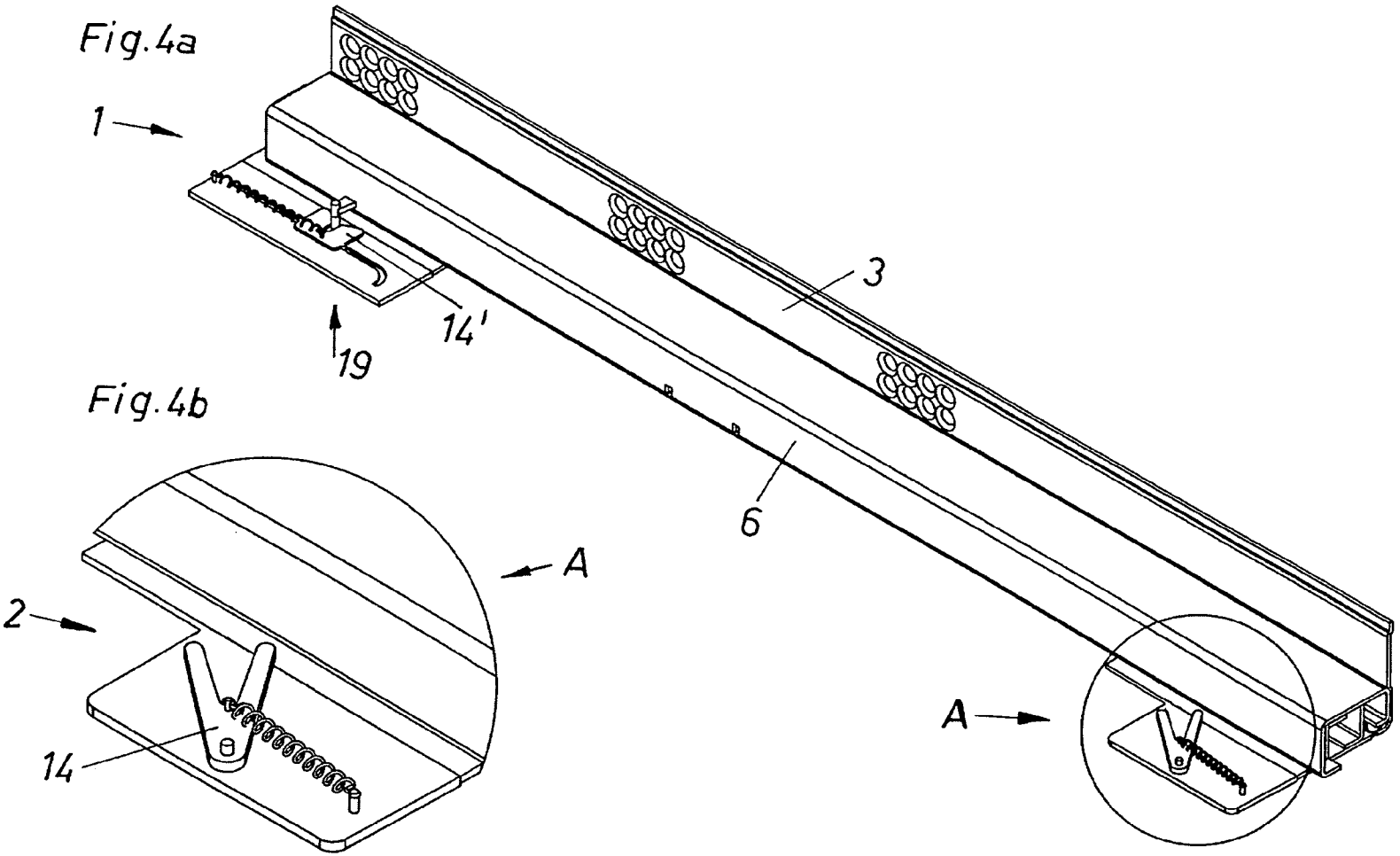
FIGS. 4*a*, 4*b* show a pull-out guide fitting with a closure device and the drive device from FIGS. 2*a*-2*c* in detailed drawings on a larger scale.

FIG. 4*a* shows a variant of the embodiment in FIGS. 3*a*-3*c*, FIG. 4*b* shows the view on a large scale of the detail A in FIG. 4*a*. In the front region of the pull-out guide fitting 1 there is a drive device 2 with a rotatably mounted v-shaped rocker segment 14 according to FIGS. 2*a*-2*c*, while the closure device 19 has a displaceably mounted rocker segment 14'. By virtue of the closure device 19 and the drive device 2, the movable furniture part can be brought, with damping, into the respective end positions of the drawer. Clearly, any possible combination of rotatably mounted rocker segment 14 and displaceably mounted rocker segment 14' in closure device 19 and drive device 2 is also possible.

Figures 5A, 5B, 5C:
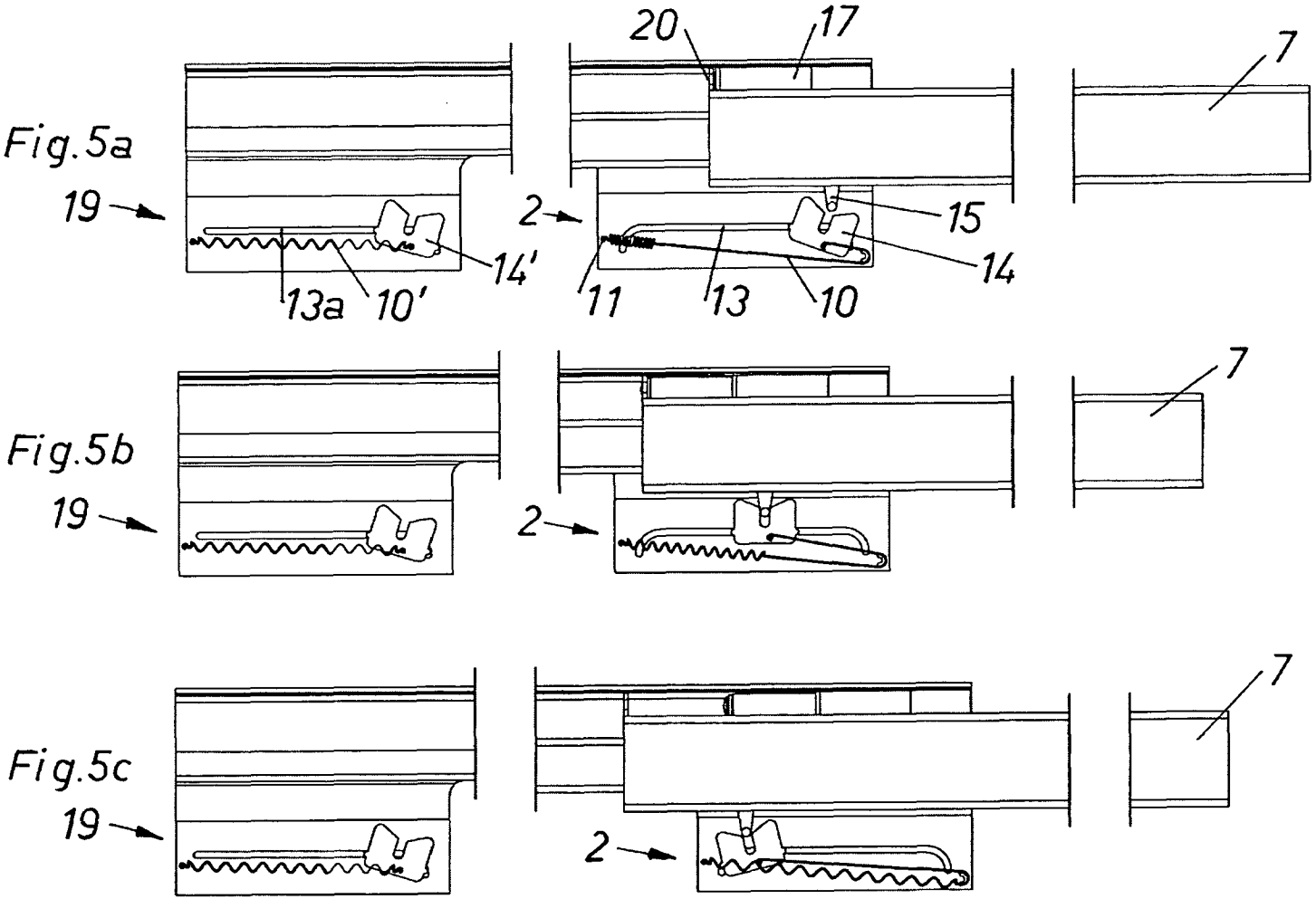
FIGS. 5*a*-5*f* illustrate the course of the closure operation of a drawer in chronological sequences.

FIGS. 5*a*-5*f* show schematically the course of a closure operation in chronological sequences. A movably mounted furniture part 7 in the form of a drawer is to be found in the fully open position in FIG. 5*a*. A damping device 17 in the form of a linear damper is disposed in the pushed in state, wherein an abutment 20 on the drawer 7 cooperates with a piston rod of the damping device 17. The closure device 19 which is arranged in the draw-in region, and the drive device 2 on the pull-out side are shown, and, in the embodiment shown, are identical in design apart from the shape of the guide paths 13, 13*a*. In FIG. 5*a*, the entrainment member 15 is disengaged from the rocker segment 14 of the drive device 2. The entrainment member 15 can be fixed or formed on the drawer 7, the furniture body, or on the pull-out rail, on the drawer-side, of a pull-out guide fitting. For the sake of simplicity, in FIGS. 5*b*-5*f*, only some of the reference numerals are shown. However, they correspond to the reference numerals of FIG. 5*a*, the same reference numerals denoting like parts. If the drawer 7 is closed (FIG. 5*b*), the entrainment member 15 is temporarily coupled with the rocker segment 14, so that the energy storage device 10 in form of a spring is tensioned. In FIG. 5*c*, the rocker segment 14 is disposed in a standby position which is arrested in self-locking manner and in which the entrainment member 15 is once again uncoupled. The drawer 7 is then freely movable over the region between the drive device 2 and the closure device 19.

Figures 5D, 5E, 5F:
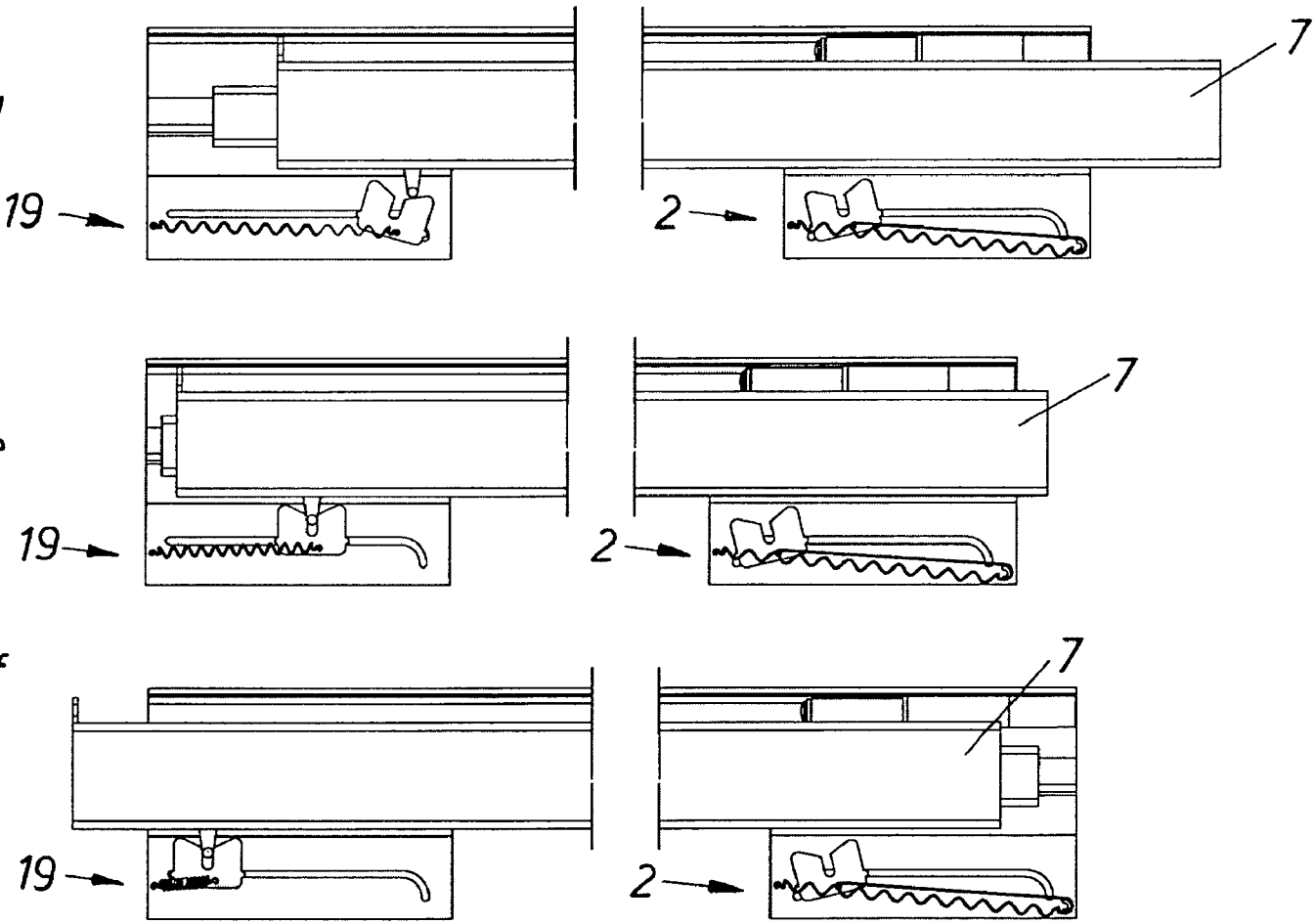

In FIG. 5*b*, the rocker segment 14' of the closure device 19 is disposed in the standby position with tensioned energy storage device 10'. The entrainment member 15 can engage in the slot of the rocker segment 14'. By virtue of the tensioned spring of the energy storage device 10', the entrainment member 15 is moved in the direction of its closure position (FIG. 5*e*), and is advantageously damped over the final closure path, so that severe impact in the fully closed position can be avoided. FIG. 5*f* shows the drawer 7 fully pushed into the furniture body. The opening operation can take place in like manner on the basis of FIG. 5*f* to FIG. 5*a*.

The present invention is not limited to the embodiments which have been shown, but can encompass, or be extended to, any variants and technical equivalents coming within the scope of the subsequent claims. The indications pertaining to positions, which have been chosen in the description, e.g. above, below, side, etc., relate to the figure shown and described directly, and are to be applied logically to the new position in the event of a change of position. It will readily be appreciated that the drive device according to the invention can be arranged, not just on one side, but also on both sides of the drawer. This is particularly expedient if large drawers, or drawers which are loaded so that they are heavy, or front pull-out fitments, are to be moved. The course of movement can therefore be more effective and smoother, and guidance of the moved furniture part can be positively influenced thereby.

The invention claimed is:

1. A drive device for assisting opening movement of a furniture part relative to a furniture body, comprising:

a first member to be fixed to one of the furniture part and the furniture body;

a second member operable to engage and disengage said first member; and an energy storage member connected to said second member, said energy storage member being operable to apply an opening force to said second member for moving said first member in an opening direction when said first member is engaged with said second member to thereby move the furniture part toward a fully open position relative to the furniture body, said energy storage member being operable to apply the opening force over only a part of an entire path of movement of the furniture part relative to the furniture body, said energy storage member being arranged so as to be at least partly discharged by moving the furniture part towards the fully open position, and so as to be recharged when the furniture part is moved in a closed direction;

wherein said energy storage member comprises a spring; and wherein said second member comprises a rocker segment connected to said spring, and said first member comprises an entrainment member for being coupled releasably to said rocker segment, said entrainment member being arranged to engage said rocker segment and thereby tension said spring during movement of the furniture part in the closed direction, wherein said rocker segment is operable to release said entrainment member when reaching a self-locking stand-by position.

2. The drive device according to claim 1, wherein said rocker segment is to be mounted on the furniture body, and said entrainment member is to be fixed to the furniture part.

3. The drive device according to claim 1, wherein said rocker segment is to be mounted on the furniture part, and said entrainment member is to be fixed to the furniture body.

4. The drive device according to claim 1, further comprising a guide member having a guide path, said rocker segment being arranged to be moved linearly along said guide path.

5. The drive device according to claim 1, wherein said rocker segment is mounted so as to be pivotable about an axis, said rocker segment being arranged to be pivoted into a self-locking stand-by position.

6. The drive device according to claim 1, further comprising a damping device for dampening the movement of the furniture part relative to the furniture body over at least part of the path of movement of the furniture part relative to the furniture body.

7. The drive device according to claim 6, wherein said damping device is to be mounted to said movable furniture part.

8. The drive device according to claim 6, wherein said damping device is to be mounted on a guide rail of a pull-out guide fitting for drawers.

9. The drive device according to claim 6, wherein said second member comprises a rocker segment, said damping device being mounted on said rocker segment.

10. The drive device according to claim 1, further comprising a closure device for moving the furniture part into a fully closed position relative to the furniture body.

11. The drive device according to claim 1, wherein the furniture part is a drawer.

12. A furniture component comprising:

a furniture body;

a furniture part movably mounted to said furniture body so as to be operable to move relative to said furniture body along a path of movement between a closed position and an open position; and a drive device for assisting opening movement of said furniture part relative to said furniture body, said drive device including:

a first member fixed to one of said furniture part and said furniture body;

a second member operable to engage and disengage said first member; and an energy storage member connected to said second member, said energy storage member being operable to apply an opening force to said second member for moving said first member in an opening direction when said first member is engaged with said second member to thereby move said furniture part toward a fully open position relative to said furniture body, said energy storage member being operable to apply the opening force over only a part of an entirety of said path of movement of said furniture part, said energy storage member being arranged so as to be at least partly discharged by moving said furniture part towards the fully open position, and so as to be recharged when said furniture part is moved in a closed direction;

wherein said energy storage member comprises a tension spring, said second member comprises a rocker segment connected to said spring, and said first member comprises an entrainment member for being coupled releasably to said rocker segment, said entrainment member being arranged to engage said rocker segment and thereby tension said spring during movement of said furniture part in the closed direction, wherein said rocker segment is operable to release said entrainment member when reaching a self-locking stand-by position.

13. The furniture component according to claim 12, wherein said rocker segment is mounted on said furniture body, and said entrainment member is fixed to said furniture part.

14. The furniture component according to claim 12, wherein said rocker segment is mounted on said furniture part, and said entrainment member is fixed to said furniture body.

15. The furniture component according to claim 12, wherein said drive device further includes a guide member having a guide path, said rocker segment being arranged to be moved linearly along said guide path.

* * * * *